United States Patent [19]

Sakaki et al.

[11] 3,939,903

[45] Feb. 24, 1976

[54] SEAL ASSEMBLY FOR A ROTARY REGENERATIVE HEAT EXCHANGER

[75] Inventors: Yoshihiro Sakaki, Yokohama; Kensuke Eishima, Urawa, both of Japan

[73] Assignee: Nissan Motor Co., Ltd., Yokohama, Japan

[22] Filed: Nov. 2, 1973

[21] Appl. No.: 412,104

[30] Foreign Application Priority Data

Nov. 20, 1972 Japan ..... 47-132633

[52] U.S. Cl. ..... 165/9; 277/96; 277/228; 277/DIG. 6; 277/DIG. 9

[51] Int. Cl.[2] ..... F28D 19/00

[58] Field of Search . 165/9; 277/96 R, 228, DIG. 6, 277/DIG. 9

[56] References Cited

UNITED STATES PATENTS

| | | | |
|---|---|---|---|
| 2,766,055 | 10/1956 | Poltorak | 277/228 X |
| 3,122,375 | 2/1964 | Greenwald | 277/96 R X |
| 3,252,505 | 5/1966 | Huebner, Jr. | 165/7 |
| 3;252,506 | 5/1966 | Huebner, Jr. | 165/10 |
| 3,301,317 | 1/1967 | Weaving et al. | 165/10 X |
| 3,601,182 | 8/1971 | Rao et al. | 165/10 X |
| 3,601,414 | 8/1971 | Rao | 165/9 X |

*Primary Examiner*—Albert W. Davis, Jr.

[57] ABSTRACT

A seal assembly comprising a seal element mounted on an interior wall of a casing having a porous carbon sealing face, and urging means to urge the seal element into sealing engagement with an adjacent end of a rotary heat accumulator rotatable within the casing.

2 Claims, 4 Drawing Figures

SEAL ASSEMBLY FOR A ROTARY REGENERATIVE HEAT EXCHANGER

The present invention relates to a seal assembly for a rotary regenerative heat exchanger having a disc-type rotary heat accumulator, and more particularly to a seal element for such a seal assembly.

A rotary regenerative heat exchanger generally comprises a casing and a disc-type rotary heat accumulator rotatable therein formed of a heat storing material and having passageways permitting the flow of fluid through the disc from end to end in a direction substantially parallel to the axis of rotation of the disc. The casing has two flow passageways, one for an initially hot fluid and another for an initially cool fluid. As the disc-type heat accumulator rotates, it passes alternatively from the hot flow passageway in which it absorbs heat from the hot fluid, to the cool flow passageway in which it gives up heat to the cool fluid the hot and cool fluids generally flow through the disc in opposite directions, and, are prevented from mixing with each other by seal assemblies which are mounted on interior walls of the casing and slidably and sealing engage with the ends of the disc. The seals are usually formed of a ceramic or heat resistive metal because they are held in sliding contact with the ends of the disc under high temperatures. A problem in sealing a rotary regenerative heat exchanger has been frequently pointed out in that the seals tend to wear at relatively high rates, and sealing is not stable over the expected life of the rotary regenerative heat exchanger.

It is accordingly an object of the present invention to provide a seal assembly for a rotary regenerative heat exchanger having a rotary heat accumulator, which has a seal element having a highly wear-resistant sealing face.

This and other objects, features and advantages of the present invention will become more apparent from the following description taken in conjunction with the accompanying drawing, wherein.

Figure 1:
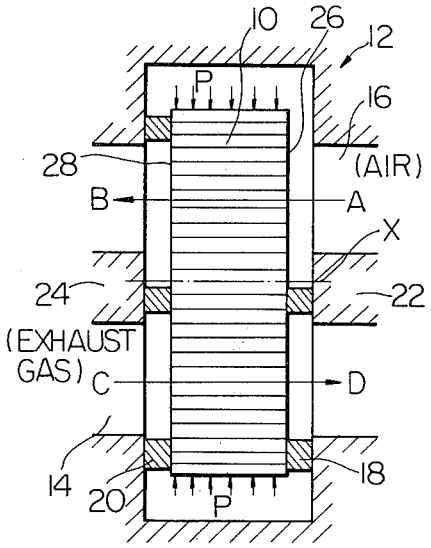
FIG. 1 is a longitudinal sectional view of a rotary regenerative heat exchanger having a disc-type rotary heat accumulator.
Figure 2:
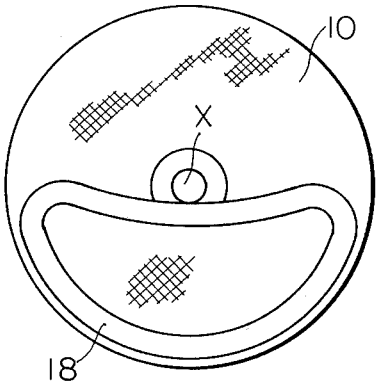
FIG. 2 is an end view of the accumulator of FIG. 1.

As illustrated in FIG. 1, a rotary regenerative heat exchanger (no numeral) is provided with a disc-type rotary heat accumulator 10 having a porous or honeycomb structure formed of a ceramic or stainless steel. The heat accumulator 10 is mounted for rotation about an axis X within a casing 12 having an exhaust gas flow passageway 14 and an air flow passageway 16. Air and exhaust gas are passed through the heat accumulator in the directions of arrows A and B respectively. Exhaust gas and air entering the accumulator 10 are initially hot and cool respectively. The heat exchanger, for the purpose of preventing air and exhaust gas from being mixed with each other, has seal assemblies 18 and 20 arranged to slidably and sealingly contact both end faces of the heat accumulator 10 as shown. The seal 18 is fixed to an interior wall 22 of the casing 12 such that it slidingly contacts a cool end 26 of the heat accumulator 10, which is subjected to relatively low temperatures, whereas the seal 20 is fixed to an interior wall 24 of the casing 12 such that it slidingly contacts with a hot end 28 of the heat accumulator 10 which is subjected to relatively high temperatures. As shown in FIG. 2, the assembly 18 is not provided at an upper portion of the heat accumulator 10, so that a pneumatic pressure P is applied to the periphery of the heat accumulator 10, and thus the rotation of heat accumulator 10 will not be affected by pneumatic pressure.

Figure 3:
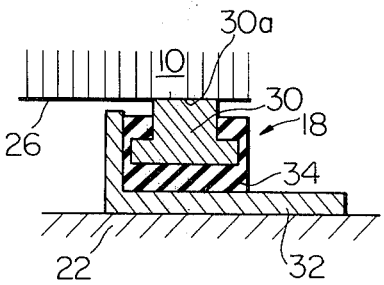
FIG. 3 is a sectional view of an embodiment of a seal assembly according to the present invention.

Referring now to FIG. 3 there is shown an embodiment of the seal assembly 18 shown in FIG. 2. The seal assembly 20 is identical or similar. The seal assembly 18 comprises a retainer 32 mounted on the interior wall 22 adjacent to the end 26 of the accumulator 10. A seal element 30 having a porous carbon sealing face **30*a* is partially imbedded in an elastomeric resilient member 34, which is fixed to the retainer 32. The element 30 has a base with a T-shape imbedded in the member 34, and the face 30a protrudes from the member 34 and is urged thereby into sealing contact with the end 26. The member 34** thus acts as an urging means, and may be formed of silicon rubber or a similar impact absorbing material.

Figure 4:
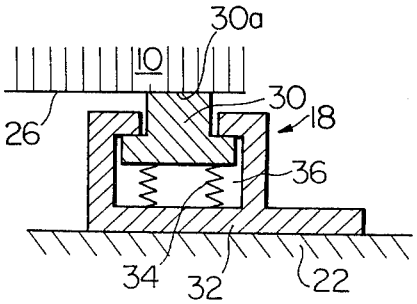
FIG. 4 shows a modification of the seal assembly of FIG. 3.

Referring next to FIG. 4, the seal assembly 18 again utilizes the T-shaped seal element 30. However, the seal assembly 18 of FIG. 4 is different from that of FIG. 3 in that the retainer 32 has a channel 36. Also in FIG. 4, the urging means or resilient member 34 is a spring disposed in the channel 36 to urge the element 30 against the end 26.

The following Table is a result of a wear test of seal elements 30.

| Sealing face material | Test temperature (°C) | Sliding velocity (m/s) | Surface pressure (kg/cm²) | Wear rate (mm/100 hr) | Heat accumulator material |
|---|---|---|---|---|---|
| Carbon | 300 | 0.5 | 0.4 | 0.10 | Ceramic |
| Carbon | 300 | 0.5 | 0.7 | 0.05 | Stainless steel |

It will now be appreciated that since a seal assembly according to the present invention has a sealing face formed of porous carbon, the carbon functions as a solid lubricant which improves the wear-resistance of the seal. Moreover, even if the sealing face wears, the wear can be compensated for by the elasticity of the resilient member 34 thereby maintaining sealing efficiency for a prolonged period of time.

What is claimed is:

1. In a rotary regenerative heat exchanger having disc-type rotary heat accumulator mounted for rotation within a casing having an interior wall adjacent to and spaced from one end of the disc-type rotary heat accumulator, a seal assembly comprising:

a L-shaped retainer mounted securely to the interior wall of said casing;

an elastomeric resilient member fixed to said L-shaped retainer; and a seal element having a carbon sealing face adjacent to the one end of said disc-type rotary heat accumulator and a base with a T-shape embedded in said elastomeric resilient member, said elastomeric resilient member being so constructed and arranged as to maintain said sealing face in sealing engagement with the end of said disc-type rotary heat accumulator.

2. A seal assembly as claimed in claim 1, in which said elastomeric resilient member is made of a silicon rubber.

* * * * *